US008260172B2

(12) United States Patent
Nozawa

(10) Patent No.: US 8,260,172 B2
(45) Date of Patent: Sep. 4, 2012

(54) IMAGE FORMING UNIT AND IMAGE FORMING APPARATUS

(75) Inventor: Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 472 days.

(21) Appl. No.: 12/560,510

(22) Filed: Sep. 16, 2009

(65) Prior Publication Data

US 2010/0074647 A1 Mar. 25, 2010

(30) Foreign Application Priority Data

Sep. 25, 2008 (JP) ..... 2008-246488

(51) Int. Cl.
*G03G 21/16* (2006.01)

(52) U.S. Cl. ..... 399/111; 399/117; 220/919; 425/289

(58) Field of Classification Search ..... 399/110, 399/111; 425/289; 220/919
See application file for complete search history.

(56) References Cited

U.S. PATENT DOCUMENTS

| | | | | |
|---|---|---|---|---|
| 5,585,902 | A * | 12/1996 | Nishiuwatoko et al. | 399/106 |
| 5,623,328 | A * | 4/1997 | Tsuda et al. | 399/111 |
| 6,640,066 | B2 * | 10/2003 | Sato | 399/106 |
| 2005/0120653 | A1 * | 6/2005 | Okazaki et al. | 52/302.1 |

FOREIGN PATENT DOCUMENTS

| | | | |
|---|---|---|---|
| JP | H06-037114 | U | 5/1994 |
| JP | 2001-282080 | A | 10/2001 |
| JP | 2005-105878 | A | 4/2005 |
| JP | 2005-157055 | A | 6/2005 |

* cited by examiner

*Primary Examiner* — Walter L Lindsay, Jr.
*Assistant Examiner* — Benjamin Schmitt
(74) *Attorney, Agent, or Firm* — Marvin A. Motsenbocker; Mots Law, PLLC

(57) ABSTRACT

An aspect of the invention provides an image forming unit that includes: an image forming unit main body including an image carrier; a housing of the image forming unit main body, the housing having at least one opening having concave parts at edge parts facing each other in the opening; and a connection element suspended with fracture parts between the edge parts facing each other in the opening, the fracture parts located within the concave parts. At least a part of the connection element corresponding to the image carrier is removable at the fracture parts.

20 Claims, 15 Drawing Sheets

IMAGE FORMING UNIT AND IMAGE FORMING APPARATUS

CROSS REFERENCE TO RELATED APPLICATIONS

This application claims priority based on 35 USC 119 from prior Japanese Patent Application No. P2008-246488 filed on Sep. 25, 2008, entitled "Image Forming Unit and Image Forming Apparatus", the entire contents of which are incorporated herein by reference.

BACKGROUND OF THE INVENTION

1. Field of the Invention

The invention relates to an image forming unit and an image forming apparatus.

2. Description of Related Art

An image forming apparatus such as a printer, a copier, a facsimile apparatus or a multifunction machine includes an image forming unit. Specifically, in the printer, for example, an image forming unit for forming a toner image on a surface of a photosensitive drum is disposed to be freely attached to and detachable from a printer main body, that is, an apparatus main body. Moreover, the image forming unit includes: a main body of the image forming unit, that is, an image forming unit main body; and a toner cartridge for containing a toner as a developer, the toner cartridge being disposed to be freely attached to and detachable from the image forming unit main body.

A housing of the image forming unit main body includes: a toner supply port formed to face the toner cartridge and configured to supply the toner into the image forming unit main body from the toner cartridge; a light receiving port formed to face an LED head and configured to expose the photosensitive drum with light generated by the LED head; and a transfer port formed to face a transfer roller and configured to transfer the toner image onto paper as a medium.

Among these ports, the light receiving port and the transfer port are required to have an opening width equal to or larger than a width of a printing area in order to access the printing area on the paper. Here, the toner supply port preferably has sufficient opening width as to allow the toner supplied into the image forming unit main body to easily spread all over the area in a rotation axis direction of the photosensitive drum in the image forming unit main body.

In the image forming unit, the toner supply port, the light receiving port and the transfer port are simultaneously formed during formation of the housing of the image forming unit main body with synthetic resin. However, during a cooling step in the formation process, deformation, warpage and the like are likely to occur in the housing.

SUMMARY OF THE INVENTION

An aspect of the invention provides an image forming unit that comprises: an image forming unit main body including an image carrier; a housing of the image forming unit main body, the housing having at least one opening having concave parts at edge parts facing each other in the opening; and a connection element suspended with fracture parts between the edge parts facing each other in the opening, the fracture parts located within the concave parts, wherein in installation of the image carrier, at least a part of the connection element corresponding to the image carrier is removed from the fracture parts.

Another aspect of the invention provides an image forming unit that comprises: a first opening through which a developer is supplied from a developer container and having a pair of first opening sides facing each other; a second opening through which light emitted by an exposure device is received to expose a photosensitive drum and having a pair of second opening sides facing each other; a third opening through which a developer image formed on the photosensitive drum is transferred onto a medium and having a pair of third opening sides facing each other; wherein at least one of the first, second, and third openings has a connection element connecting its pair of sides facing each other, wherein the connection element is connected to the sides in concave parts formed in the sides.

Still another aspect of the invention provides an image forming apparatus comprising the image forming unit described above.

The housing of the image forming unit main body includes at least one opening, and the connection element is suspended between the edge parts facing each other in the opening. Thus, deformation, warpage and the like are prevented from occurring in the housing during a cooling step in the formation process. Therefore, a portion around the opening no longer comes into contact with the image carrier. Thus, it is possible to not only prevent the portion from damaging the image carrier, blocking a medium conveying path or interrupting exposure on the surface of the image carrier but also prevent the developer from leaking from between the housing and the developer container. As a result, an image can be reliably formed on the medium and image quality can be improved.

DETAILED DESCRIPTION OF EMBODIMENTS

Figure 1:
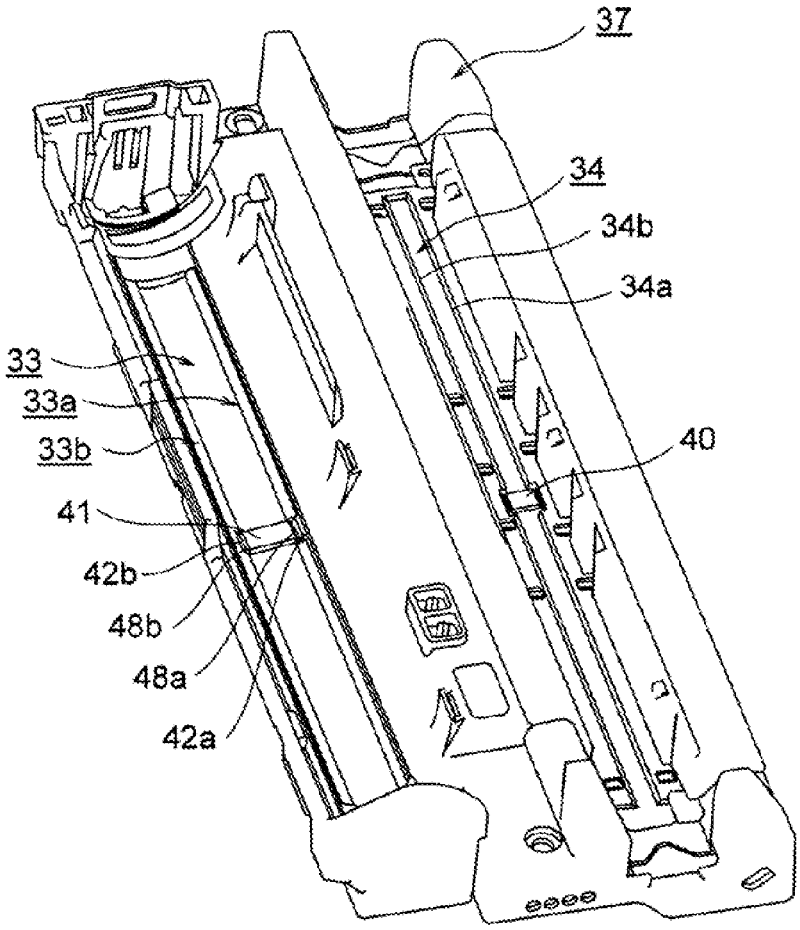
FIG. 1 is a perspective view of an upper frame according to a first embodiment.

Descriptions are provided herein below for embodiments based on the drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

Printers of the embodiment are described as an example of an image forming apparatus. The embodiment can be applied not only to printers, but also copiers, facsimile apparatus or multifunction machines.

Figure 2:
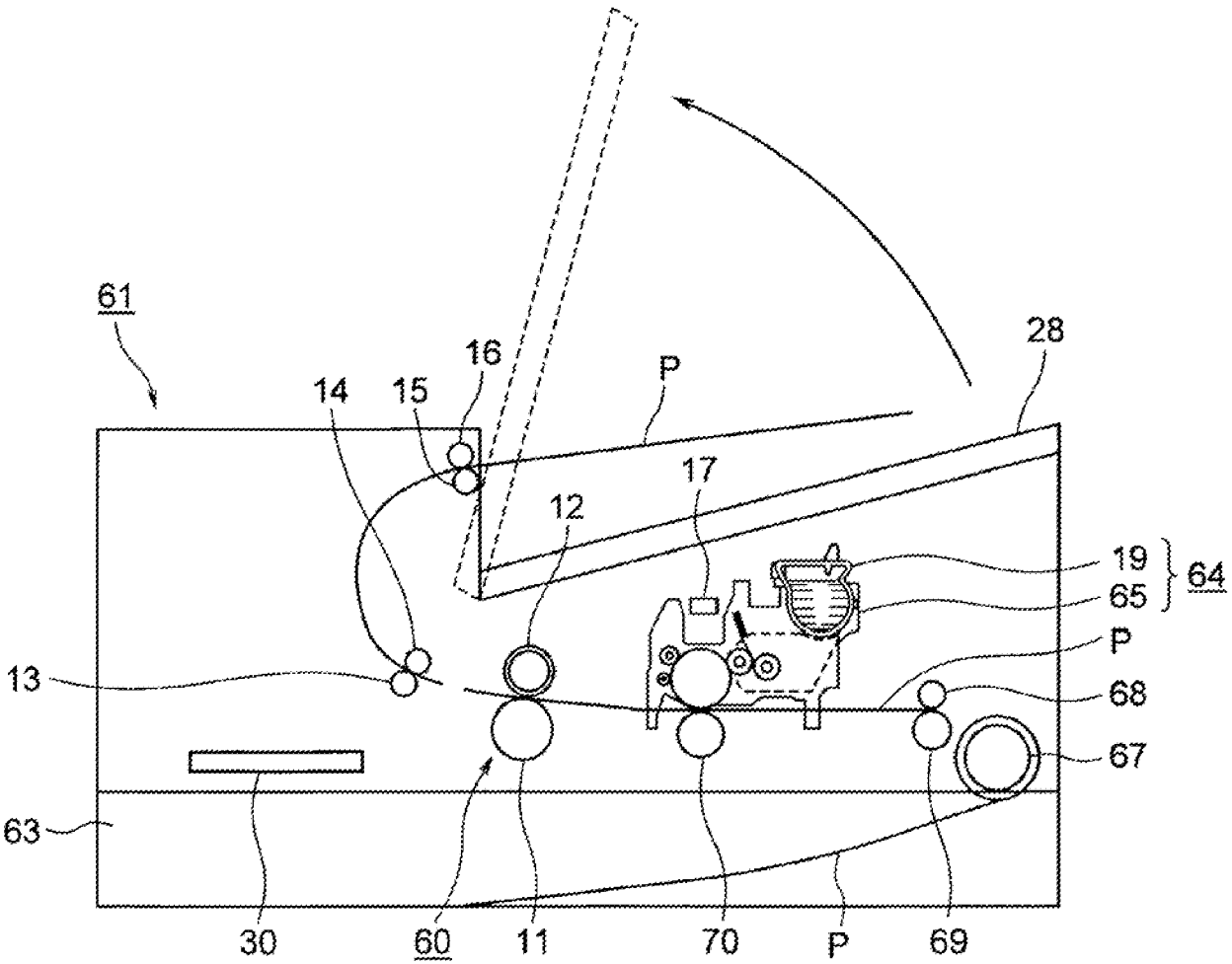
FIG. 2 is a schematic diagram of a printer according to the first embodiment.
Figure 3:
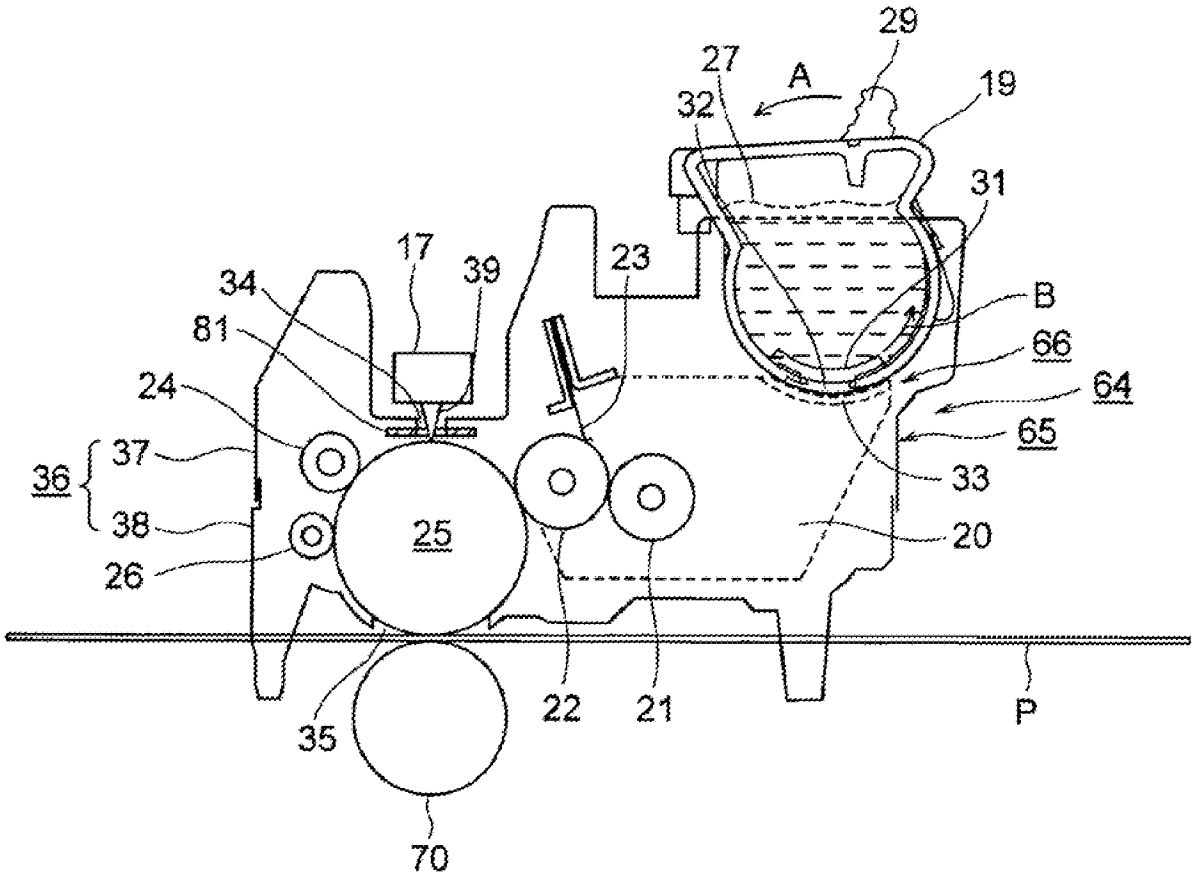
FIG. 3 is a schematic diagram showing an arrangement state of an image forming unit according to the first embodiment.

FIG. 2 is a schematic diagram of a printer according to a first embodiment. FIG. 3 is a schematic diagram showing an arrangement state of an image forming unit according to the first embodiment.

As shown in FIGS. 2 and 3, printer 61 includes: paper cassette 63 as a medium container for containing paper P as a medium; image forming unit (which forms a developing device, a drum cartridge and the like) 64 disposed to be freely attached to and detachable from a main body of printer 61 and configured to form a toner image as a developer image; LED head 17 as an exposure device; transfer roller 70 as a transfer member; fixing unit 60 as a fixing device. Fixing unit 60 includes pressure roller 11 as a first roller, heating roller 12 as a second roller.

At a front end of paper cassette 63, hopping roller 67 is provided as a feed roller for separating paper P sheet by sheet, sending out the paper and feeding the paper onto a paper conveying path as a medium conveying path. Moreover, on a downstream side of hopping roller 67 on the paper conveying path, a pair of resist rollers 68 and 69 are provided. Note that reference numeral 28 is a top cover provided to be openable and closable with respect to the apparatus main body. Top cover 28 forms a stacker as a medium stacking unit. Moreover, reference numeral 30 is a control board configured to perform overall control of printer 61. Note that image forming unit 64 can be attached to or detached from the apparatus main body by opening top cover 28.

Image forming unit 64 includes a main body of image forming unit 64, that is, image forming unit main body 65 and toner cartridge 19 as a developer container for containing toner 27 as a developer, the toner cartridge being disposed to be freely attached to and detachable from image forming unit main body 65. Moreover, image forming unit main body 65 includes: photosensitive drum 25 as an image carrier; charging roller 24 as a charging device for uniformly charging a surface of photosensitive drum 25; developing unit 66 configured to develop an image by allowing toner 27 to adhere to an electrostatic latent image as a latent image formed on the surface of photosensitive drum 25; cleaning roller 26 as a cleaning member configured to recover toner 27 onto developing roller 22 as a developer carrier, the toner being left on the surface of photosensitive drum 25 after transferring of the toner image.

Moreover, developing unit 66 includes: developing roller which is rotatably disposed in abutting contact with photosensitive drum 25, carries toner 27, develops an image by allowing toner 27 to adhere to the electrostatic latent image, and thus forms the toner image; toner supply roller 21 as a developer supply member for supplying toner 27 to developing roller 22 while charging toner 27, the toner supply roller being rotatably disposed in abutting contact with developing roller 22; and developing blade 23 as a developer regulating member for forming a toner layer as a developer layer having a uniform thickness on developing roller 22, the developing blade being disposed while having its tip in abutting contact with developing roller 22. Note that housing 36 of image forming unit main body 65 includes upper frame 37 and base frame 38.

Photosensitive drum 25 is formed in a cylindrical shape by coating a conductive metal shaft made of aluminum or the like with an organic photoreceptor. Photosensitive drum 25 is rotatably disposed relative to housing 36 of image forming unit main body 65. Furthermore, charging roller 24 includes a conductive base layer and a surface layer made of semiconductive rubber such as epichlorohydrin rubber.

Developing roller 22 is formed in a cylindrical shape by coating a conductive metal shaft with semiconductive rubber such as silicone. Furthermore, toner supply roller 21 is formed in a cylindrical shape by coating a conductive metal shaft with resin having a blowing agent added thereto during mixing in order to improve flow of toner 27.

On image forming unit main body 65, LED head 17 is disposed to face photosensitive drum 25. LED head 17 forms an electrostatic latent image by exposing the surface of photosensitive drum 25. Moreover, below image forming unit main body 65, transfer roller 70 is disposed to face photosensitive drum 25. Transfer roller 70 transfers the toner image formed on photosensitive drum 25 onto paper P. LED head 17 may be disposed to top cover 28 and transfer roller 70 may be disposed to main body of printer 61.

On a downstream side of fixing unit 60 on the paper conveying path, discharge rollers 13 to 16 are provided. Paper P passing fixing unit 60 is conveyed by discharge rollers 13 to 16, discharged to the outside of the apparatus main body and stacked on top cover 28.

Moreover, lever 29 as an operating unit is swingably attached to toner cartridge 19. By turning lever 29 in arrow A direction, inner case 31 is turned in arrow B direction to open toner discharge port 32. Toner 27 passes through toner supply port 33 as a first opening and a developer supply port, and is supplied into toner holding space 20 as a developer holding space inside image forming unit main body 65.

Toner 27 supplied into toner holding space 20 is supplied onto developing roller 22 by rotation of toner supply roller 21. On developing roller 22, a thin film of toner 27 is formed by developing blade 23.

In printer 61 thus configured, and described above, the surface of photosensitive drum 25 is uniformly charged by charging roller 24 and is exposed through light receiving port 34 as a second opening with light 39 generated by LED head 17. Thus, an electrostatic latent image is formed. Thereafter, toner 27 on developing roller 22 is allowed to adhere to the electrostatic latent image and thus a toner image is formed.

Paper P sent out sheet by sheet by hopping roller 67 is conveyed by resist rollers 68 and 69, sent between image forming unit 64 and transfer roller 70, and then comes into contact with photosensitive drum 25 at transfer port 35 as a third opening. Here, transfer roller 70 transfers the toner image onto paper P.

Subsequently, paper P having the toner image transferred thereon is sent to fixing unit 60. In fixing unit 60, the toner image is heated and pressurized to be fixed on paper P. Thus, an image is formed. Subsequently, paper P is conveyed by discharge rollers 13 to 16, discharged to the outside of the apparatus main body and stacked on top cover 28.

Toner 27 left on the surface of photosensitive drum 25 after transferring is scraped off by cleaning roller 26, allowed again to adhere to photosensitive drum 25, conveyed by rotation of photosensitive drum 25 and then recovered by developing roller 22. In this event, in order to prevent toner 27 from adhering to LED head 17 while passing light receiving port 34, toner adhesion preventing member 81 as a developer adhesion preventing member made of a metal plate is provided between light receiving port 34 and photosensitive drum 25. Electrical charges are applied to toner adhesion preventing member 81.

Next, housing 36 of image forming unit 64 is described.

Figure 4:
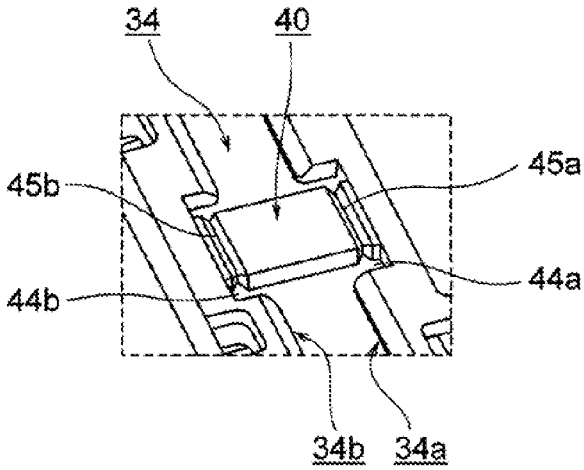
FIG. 4 is a first detail view showing an arrangement state of a connection rib according to the first embodiment.
Figure 5:
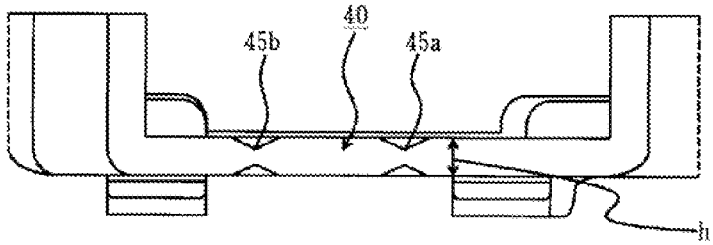
FIG. 5 is a first cross-sectional view showing the arrangement state of the connection rib according to the first embodiment.

FIG. 1 is a perspective view of the upper frame according to the first embodiment. FIG. 4 is a first detail view showing an arrangement state of a connection rib according to the first embodiment. FIG. 5 is a first cross-sectional view showing the arrangement state of the connection rib according to the first embodiment.

Upper frame 37 is made of synthetic resin and includes light receiving port 34 and toner supply port 33 which are formed simultaneously during formation of the upper frame. Light receiving port 34 is formed as a hole extended in a longitudinal direction (an axial direction of image forming unit 64). In the formation process, connection rib 40 as a reinforcing part and a connection element is formed at a predetermined position, in this embodiment, at a center portion of light receiving port 34 in the longitudinal direction. Connection rib 40 is suspended between edge parts 34*a* and 34*b* on sides facing each other, the on long sides.

Thus, in center portions of edge parts 34*a* and 34*b* in the longitudinal direction, concave parts 44*a* and 44*b* as notch parts are formed to enlarge light receiving port 34 outward. In concave parts 44*a* and 44*b*, connection rib 40 and edge parts 34*a* and 34*b* are connected to each other. Moreover, at connection portions where connection rib 40 and edge parts 34*a* and 34*b* are connected to each other, fracture parts 45*a* and 45*b* are formed, of which cross-sectional areas are locally reduced by notch grooves. As shown in FIG. 5, a thickness of each of fracture parts 45*a* and 45*b* is set smaller than thickness h of connection rib 40. Note that fracture parts 45*a* and 45*b* are formed inside concave parts 44*a* and 44*b*, that is, formed outside a portion where concave parts 44*a* and 44*b* are not formed on edge parts 34*a* and 34*b*.

Moreover, toner supply port 33 is also formed as a hole extended in the longitudinal direction (the axial direction of image forming unit 64). In the formation process, connection rib 41 as a reinforcing part and a connection element is formed at a predetermined location, in this embodiment, at a center portion of the toner supply port 33 in the longitudinal direction. Connection rib 41 is suspended between edge parts 33*a* and 33*b* on sides facing each other, the on long sides.

Thus, in center portions of edge parts 33*a* and 33*b* in the longitudinal direction, concave parts 42*a* and 42*b* as notch parts are formed to enlarge toner supply port 33 outward. In concave parts 42*a* and 42*b*, connection rib 41 and edge parts 33*a* and 33*b* are connected to each other. Moreover, at connection portions where connection rib 41 and edge parts 33*a* and 33*b* are connected to each other, fracture parts 48*a* and 48*b* are formed, of which cross-sectional areas are locally reduced by notch grooves. A thickness of each of fracture parts 48*a* and 48*b* is set smaller than thickness h of connection rib 41. Note that fracture parts 48*a* and 48*b* are formed inside concave parts 42*a* and 42*b*, that is, formed outside a portion where concave parts 42*a* and 42*b* are not formed on edge parts 33*a* and 33*b*.

Figure 6:
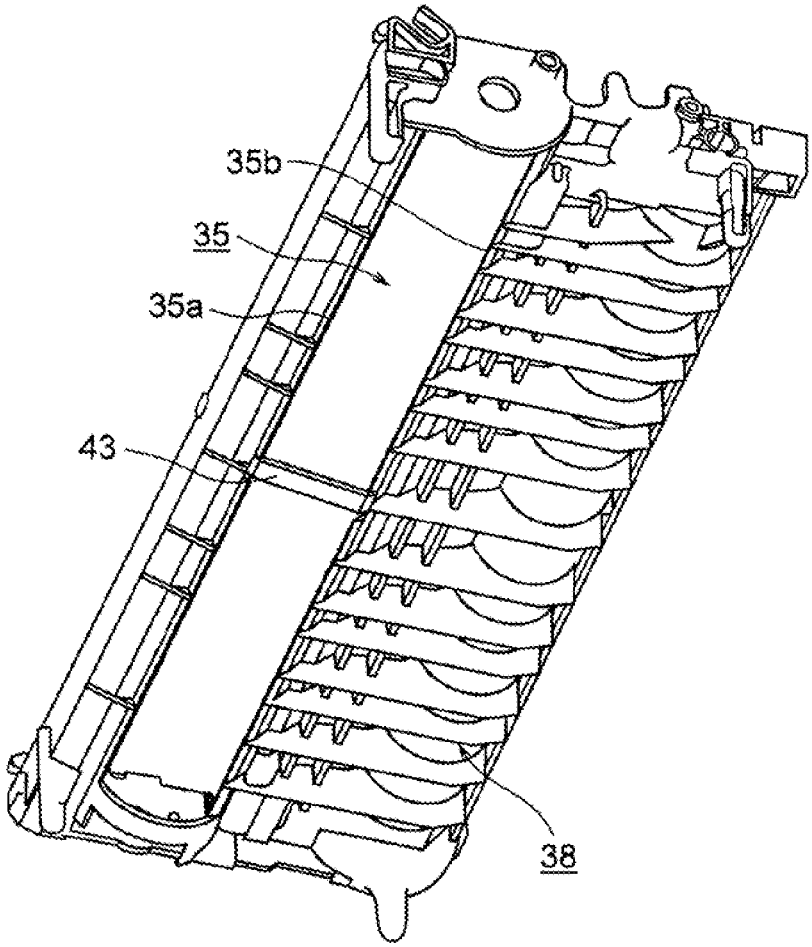
FIG. 6 is a perspective view of a base frame according to the first embodiment.
Figure 7:
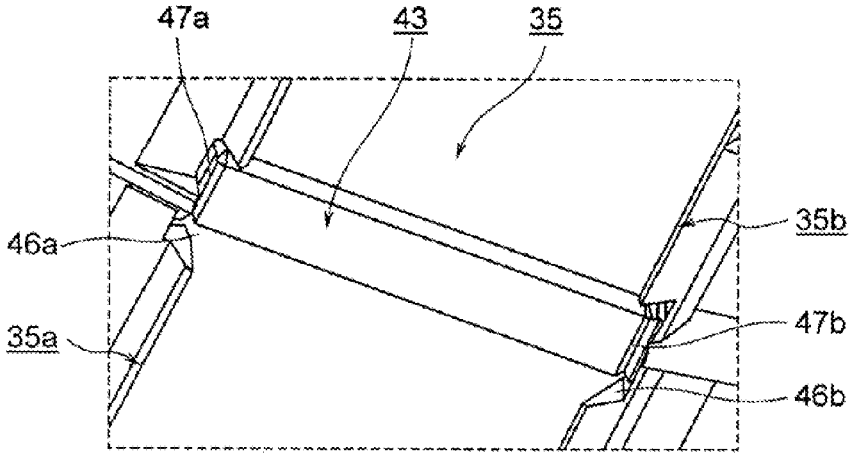
FIG. 7 is a second detail view showing the arrangement state of the connection rib according to the first embodiment.
Figure 8:
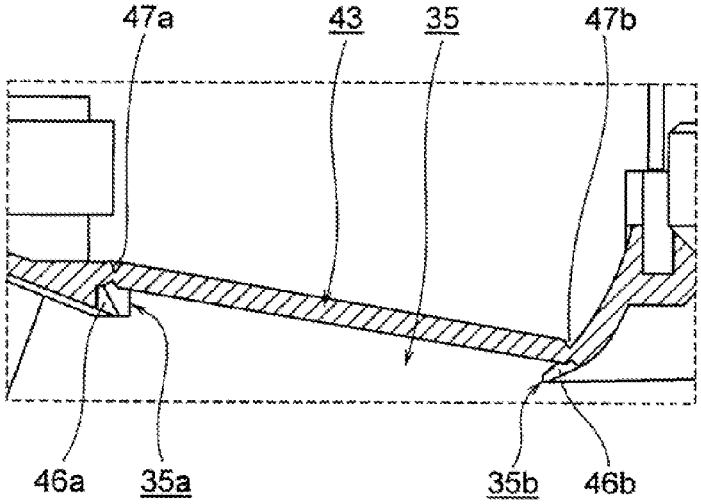
FIG. 8 is a second cross-sectional view showing the arrangement state of the connection rib according to the first embodiment.

FIG. 6 is a perspective view of the base frame according to the first embodiment. FIG. 7 is a second detail view showing the arrangement state of the connection rib according to the first embodiment. FIG. 8 is a second cross-sectional view showing the arrangement state of the connection rib according to the first embodiment.

Base frame 38 is made of synthetic resin and includes transfer port 35 formed simultaneously during formation of the base frame. Transfer port 35 is formed as a hole extended in the longitudinal direction (the axial direction of image forming unit 64). In the formation process, connection rib 43 as a reinforcing part and a connection element is formed at a predetermined location, in this embodiment, at a center portion of transfer port 35 in the longitudinal direction. Connection rib 43 is suspended between edge parts 35*a* and 35*b* on sides facing each other on the long sides.

Thus, in center portions of edge parts 35*a* and 35*b* in the longitudinal direction, concave parts 46*a* and 46*b* as notch parts are formed to enlarge transfer port 35 outward. In concave parts 46*a* and 46*b*, connection rib 43 and edge parts 35*a* and 35*b* are connected to each other. Moreover, at connection portions where connection rib 43 and edge parts 35*a* and 35*b* are connected to each other, fracture parts 47*a* and 47*b* are formed, of which cross-sectional areas are locally reduced by notch grooves. As shown in FIG. 8, a thickness of each of fracture parts 47*a* and 47*b* is set smaller than a thickness of connection rib 43. Note that fracture parts 47*a* and 47*b* are formed inside concave parts 46*a* and 46*b*, that is, formed outside a portion where concave parts 46*a* and 46*b* are not formed on edge parts 35*a* and 35*b*.

Incidentally, as described above, in the formation process of upper frame 37, connection rib 40 is formed in light receiving port 34 and connection rib 41 is formed in toner supply port 33. Moreover, in the formation process of base frame 38, connection rib 43 is formed in transfer port 35. Therefore, deformation, warpage and the like are prevented from occurring in upper frame 37 and base frame 38 during a cooling step in the formation process.

Then, a jig or the like is used to apply impact to connection ribs 40, 41 and 43 or fracture parts 45*a*, 45*b*, 48*a*, 48*b*, 47*a* and 47*b* after the cooling step is completed and contraction of upper frame 37 and base frame 38 is stabilized. At this time, stress is concentrated on fracture parts 45*a*, 45*b*, 48*a*, 48*b*, 47*a* and 47*b* because of their reduced cross-sectional areas. Thus, fracture parts 45*a*, 45*b*, 48*a*, 48*b*, 47*a* and 47*b* are easily broken. Therefore, connection ribs 40, 41 and 43 can be easily removed.

Figure 9:
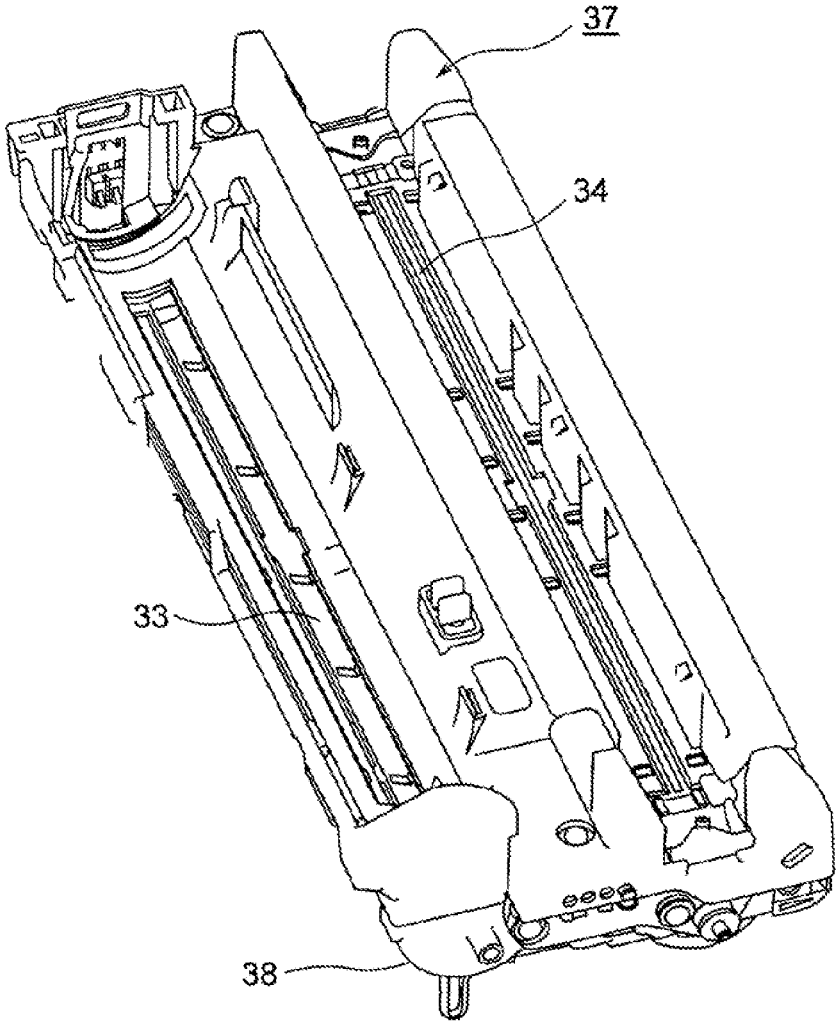
FIG. 9 is a first perspective view showing the image forming unit after removal of the connection rib according to the first embodiment.
Figure 10:
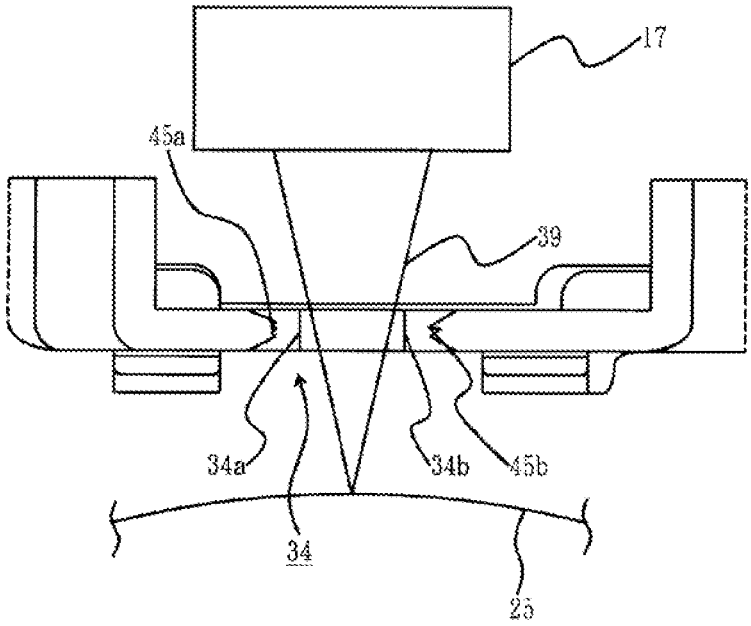
FIG. 10 is a cross-sectional view showing a state of alight receiving port after removal of the connection rib according to the first embodiment.
Figure 11:
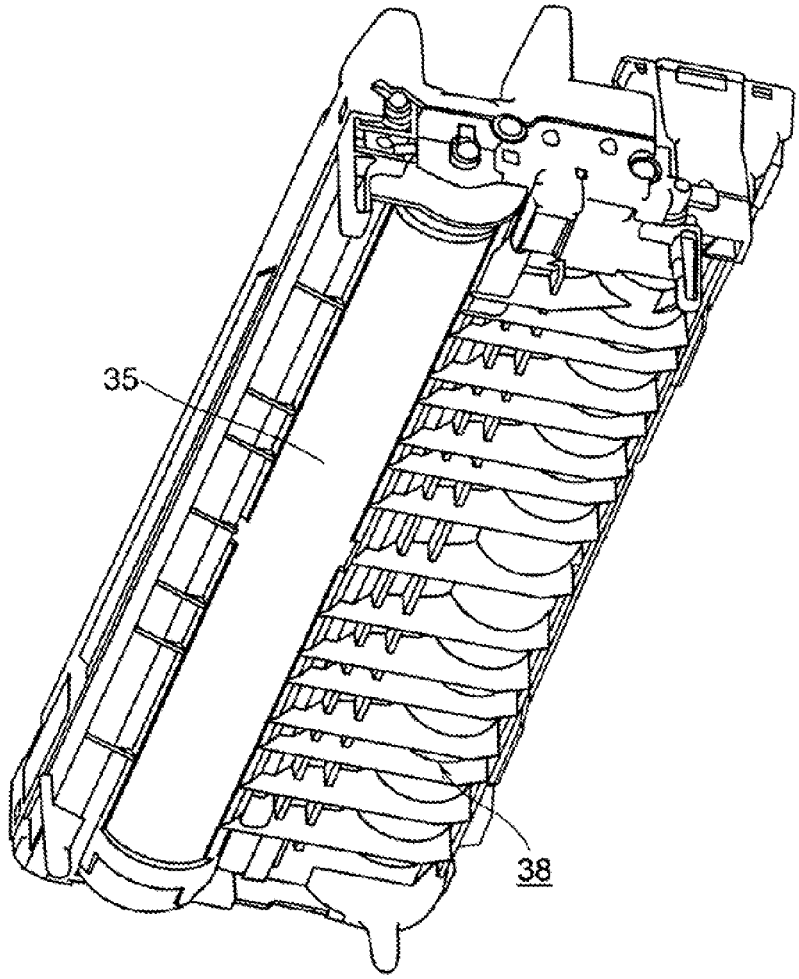
FIG. 11 is a second perspective view showing the image forming unit after removal of the connection rib according to the first embodiment.
Figure 12:
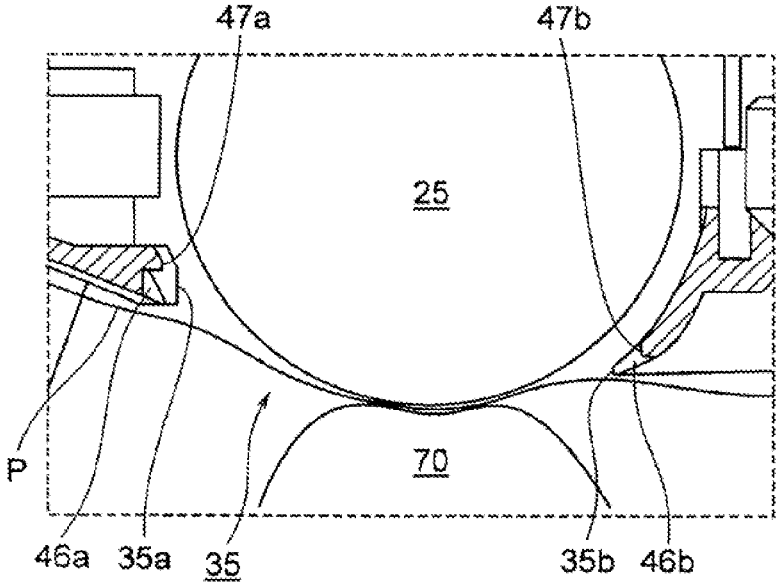
FIG. 12 is a cross-sectional view showing a state of a transfer port after removal of the connection rib according to the first embodiment.

FIG. 9 is a first perspective view showing the image forming unit after removal of the connection rib according to the first embodiment. FIG. 10 is a cross-sectional view showing a state of the light receiving port after removal of the connection rib according to the first embodiment. FIG. 11 is a second perspective view showing the image forming unit after removal of the connection rib according to the first embodiment. FIG. 12 is a cross-sectional view showing a state of the transfer port after removal of the connection rib according to the first embodiment.

As described above, in upper frame 37, fracture parts 45*a* and 45*b* are formed outside the portion where concave parts 44*a* and 44*b* are not formed on edge parts 34*a* and 34*b*, while fracture parts 48*a* and 48*b* are formed outside the portion where concave parts 42*a* and 42*b* (FIG. 1) are not formed on edge parts 33*a* and 33*b*. Thus, remaining pieces of fracture parts 45*a* and 45*b* in light receiving port 34 after removal of connection rib 40 do not interrupt exposure of light 39 or remaining pieces of fracture parts 48*a* and 48*b* in toner supply port 33 after removal of connection rib 41 do not block supply of toner 27.

Moreover, in base frame 38, fracture parts 47*a* and 47*b* (FIGS. 7 and 8) are formed outside the portion where concave parts 46*a* and 46*b* are not formed on edge parts 35*a* and 35*b*. Thus, remaining pieces of fracture parts 47*a* and 47*b* in transfer port 35 after removal of connection rib 43 do not damage photosensitive drum 25, block the paper conveying path or interrupt transferring of the toner image.

Note that although connection ribs 40, 41 and 43 are formed in a printing area in this embodiment, the connection ribs can also be formed outside the printing area. In such a case, positions of the connection ribs are set so that, in installation of predetermined components in upper frame 37, base frame 38 and the like, the connection ribs are removed when coming into contact with the components. For example, the connection ribs can be removed by a force applied to the connection ribs when the connection ribs come into contact with predetermined spots on photosensitive drum 25 in installation of photosensitive drum 25 in base frame 38.

As described above, in the embodiment, connection ribs 40, 41 and 43 are formed in light receiving port 34, toner supply port 33 and transfer port 35 during the formation process. Thus, deformation, warpage and the like are prevented from occurring in housing 36 (FIG. 3) during the cooling step in the formation process. Therefore, predetermined portions around light receiving port 34, toner supply port 33 and transfer port 35 no longer come into contact with photosensitive drum 25. Thus, it is possible to not only prevent the portions from damaging photosensitive drum 25, blocking the paper conveying path or interrupting exposure on the surface of photosensitive drum 25 but also prevent toner 27 from leaking from between housing 36 and toner cartridge 19. As a result, an image can be reliably formed on paper P and image quality can be improved.

Moreover, fracture parts 45*a* and 45*b* are formed outside the portion where concave parts 44*a* and 44*b* are not formed on edge parts 34*a* and 34*b*, fracture parts 48*a* and 48*b* are formed outside the portion where concave parts 42*a* and 42*b* are not formed on edge parts 33*a* and 33*b*, and fracture parts 47*a* and 47*b* are formed outside the portion where concave parts 46*a* and 46*b* are not formed on edge parts 35*a* and 35*b*. Thus, after removal of connection ribs 40, 41 and 43, interruption of exposure of light 39, blocking of supply of toner 27, damaging of photosensitive drum 25, blocking of the paper conveying path or interruption of transferring of the toner image is prevented.

Note that, in the embodiment, connection ribs 40, 41 and 43 are formed in light receiving port 34, toner supply port 33 and transfer port 35, respectively, one for each port. However, plural connection ribs can be formed for each of light receiving port 34, toner supply port 33 and transfer port 35.

Moreover, in the embodiment, connection ribs 40, 41 and 43 are removed after the cooling step is completed. However, the connection ribs can be left, as needed, without being removed.

Next, a second embodiment is described. Note that parts having the same structures as those in the first embodiment are denoted by the same reference numerals and description thereof is omitted. As for effects of the invention achieved by having the same structures, the effects of the first embodiment are incorporated.

Figure 13:
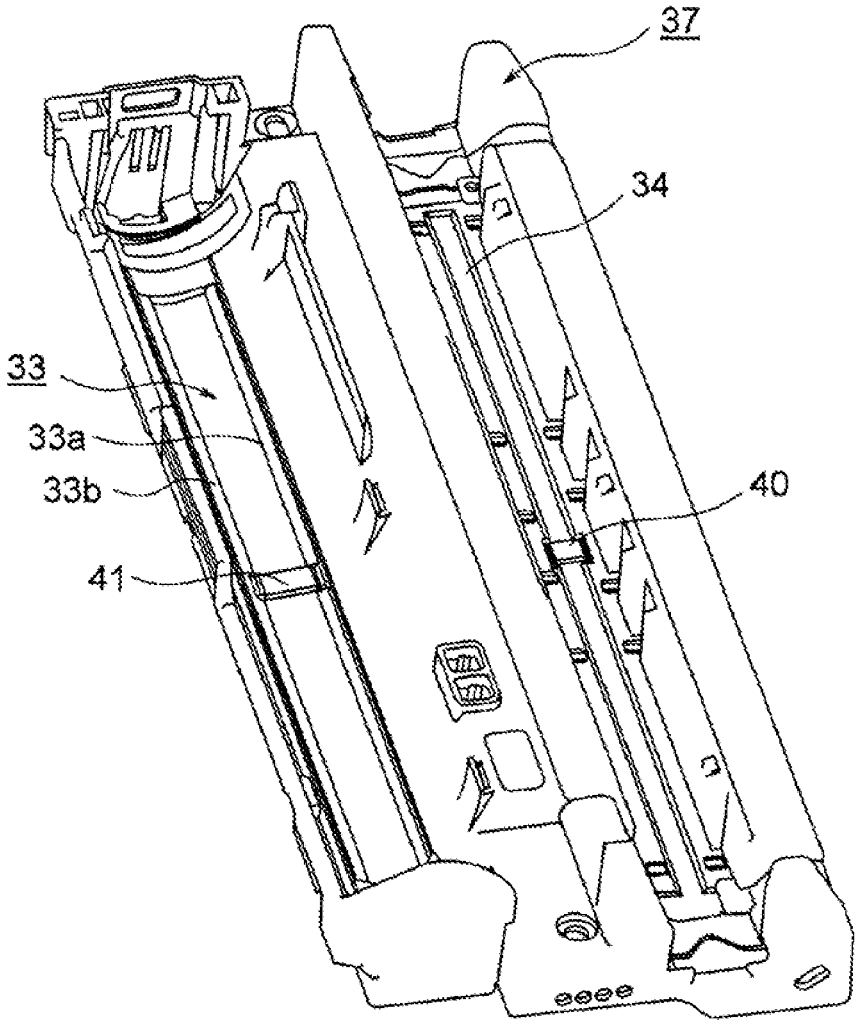
FIG. 13 is a perspective view of an upper frame according to a second embodiment.
Figure 14:
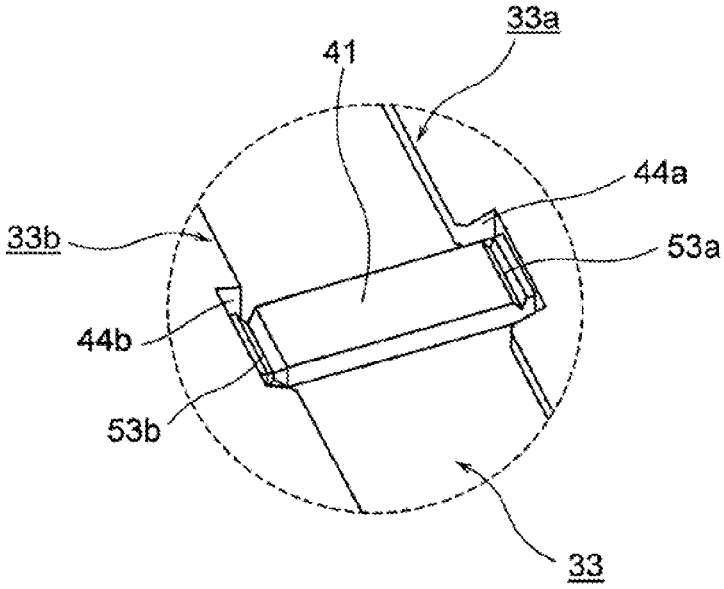
FIG. 14 is a detail view showing an arrangement state of a connection rib according to the second embodiment.
Figure 15:
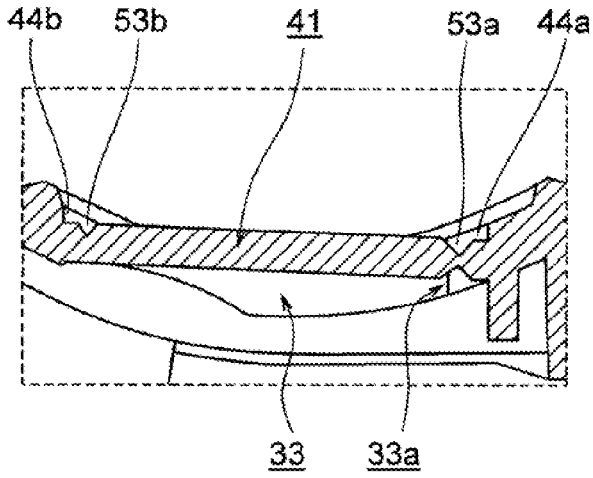
FIG. 15 is a cross-sectional view showing the arrangement state of the connection rib according to the second embodiment.

FIG. 13 is a perspective view of an upper frame according to the second embodiment. FIG. 14 is a detail view showing an arrangement state of a connection rib according to the second embodiment. FIG. 15 is a cross-sectional view showing the arrangement state of the connection rib according to the second embodiment.

In this case, connection ribs 40, 41 and 43 as reinforcing parts and connection elements have the same structure. Thus, only connection rib 41 is described.

In this embodiment, during a formation process of upper frame 37, at connection portions where connection rib 41 and edge parts 33*a* and 33*b* are connected to each other, fracture parts 53*a* and 53*b* are formed, of which cross-sectional areas are locally reduced by notch grooves. A thickness of each of fracture parts 53*a* and 53*b* is set smaller than a thickness of connection rib 41, and, a thickness of fracture part 53*a* is set smaller than that of fracture part 53*b*.

In this case, when a jig or the like is used to apply impact to connection rib 41 or fracture part 53*a*, stress is concentrated on fracture part 53*a* because of its reduced cross-sectional area. Thus, fracture part 53*a* is easily broken. Therefore, connection rib 41 can be easily removed. Note that fracture part 53*b* is not broken since its thickness is larger than that of fracture part 53*a*.

Figure 16:
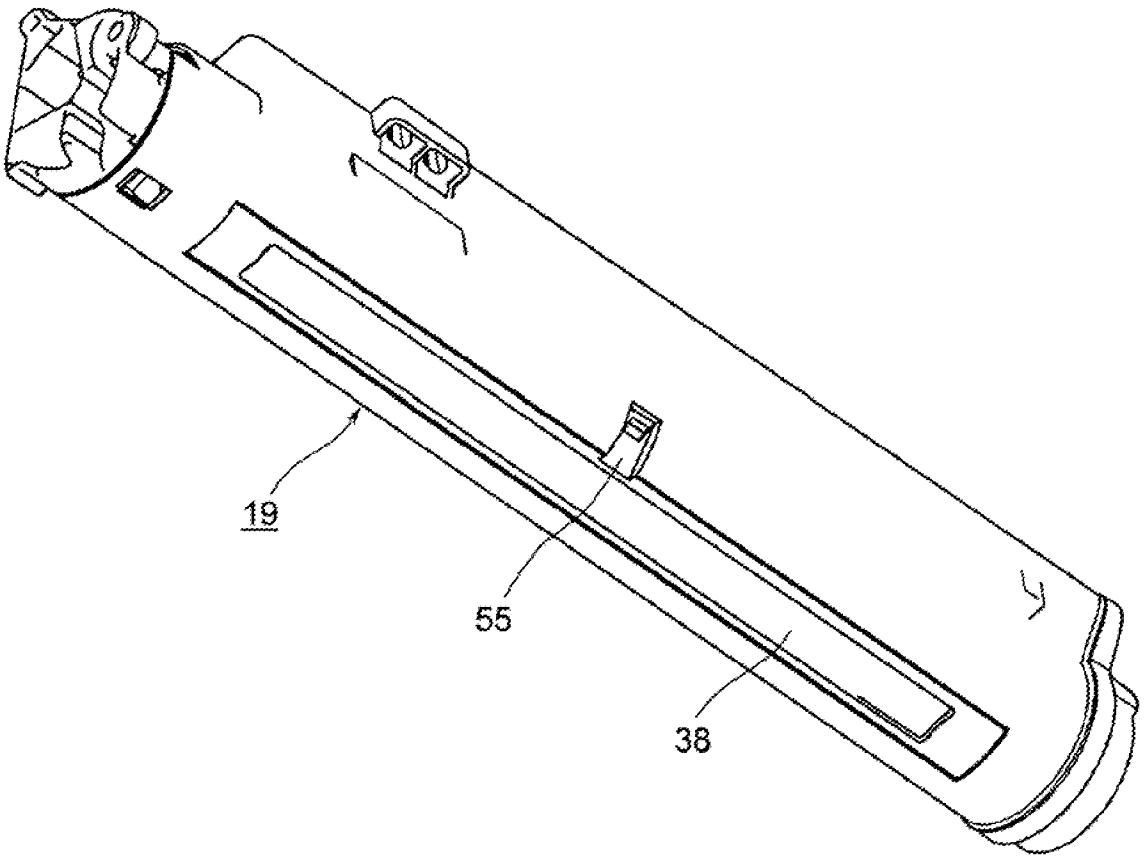
FIG. 16 is a perspective view of a toner cartridge according to the second embodiment.
Figure 17:
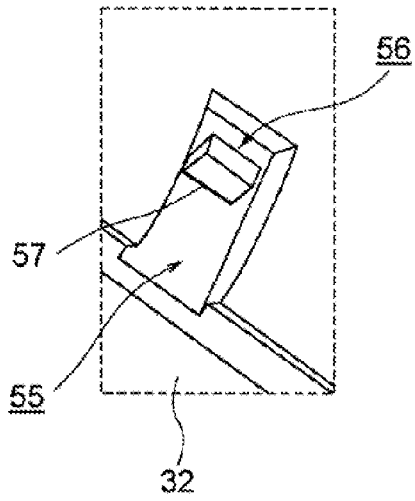
FIG. 17 is an enlarged view around a rib receiver according to the second embodiment.

FIG. 16 is a perspective view of a toner cartridge according to the second embodiment. FIG. 17 is an enlarged view around a rib receiver according to the second embodiment.

In toner cartridge 19 as a developer container for containing toner 27 (FIG. 3) as a developer, rib receiver 55 formed of a concave part is formed adjacent to base frame 38 at a position corresponding to the connection rib 41 when the cartridge is attached to image forming unit main body 65 at a center portion in a longitudinal direction (an axial direction of photosensitive drum 25 in image forming unit 64) of base frame 38. Rib receiver 55 can hold removed connection rib 41. For that purpose, a width of rib receiver 55 is set slightly larger than that of connection rib 41, while a length of rib receiver 55 is set slightly larger than that of connection rib 41.

Moreover, inside rib receiver 55, protrusion 56 is formed as a lock-out interference member for preventing toner cartridge 19 from being erroneously attached to, for example, an image forming unit having different specifications than corresponding image forming unit main body 65. In protrusion 56, fracture part 57 is formed, of which cross-sectional area is locally reduced, at its base. Note that, depending on the specifications, protrusion 56 is previously removed from fracture part 57 by use of a jig and the like, or is left without being removed before shipment.

Figure 18:
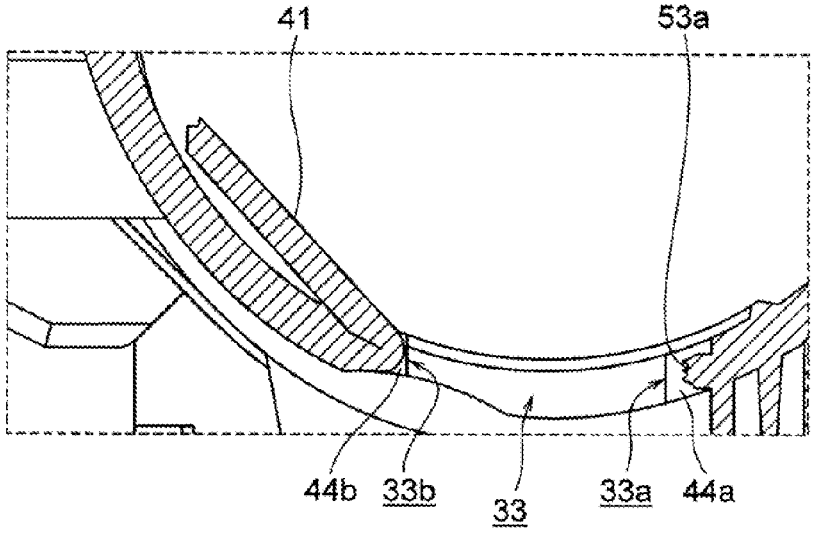
FIG. 18 is a view showing a state where the connection rib is removed according to the second embodiment.
Figure 19:
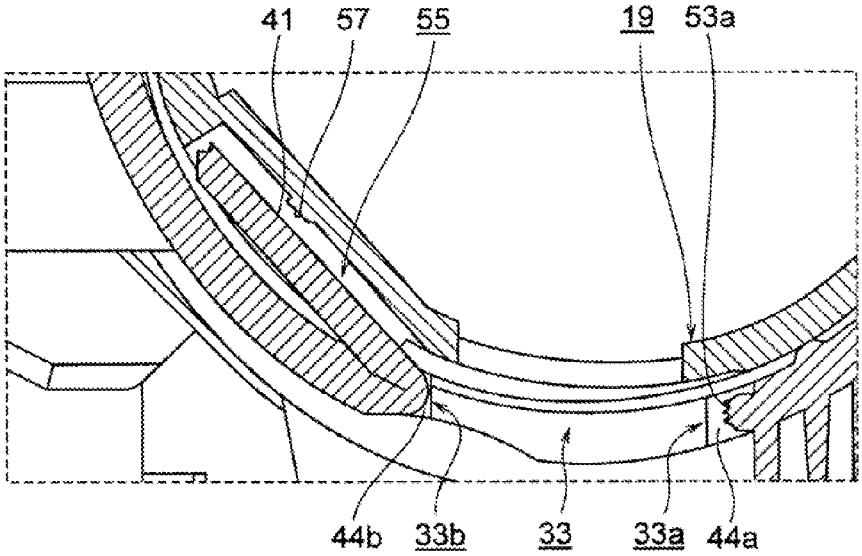
FIG. 19 is a first view showing a state where the toner cartridge is attached to an image forming unit main body according to the second embodiment.
Figure 20:
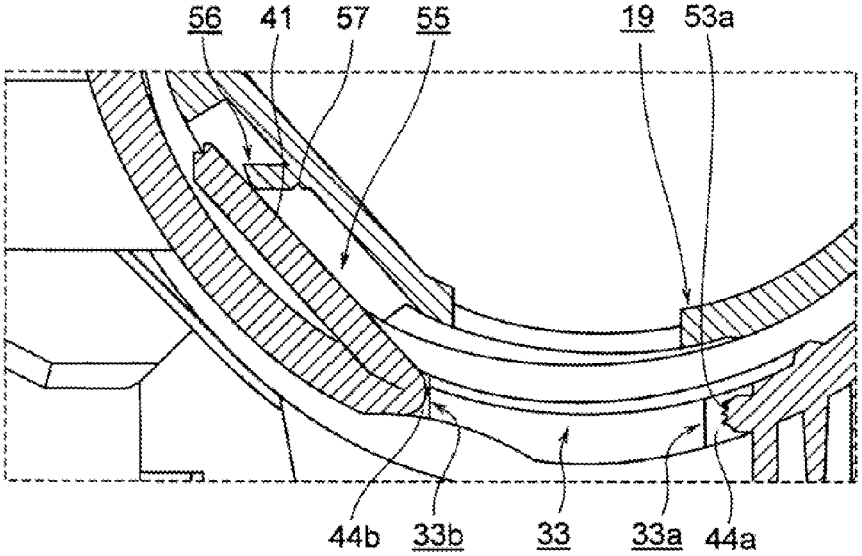
FIG. 20 is a second view showing the state where the toner cartridge is attached to the image forming unit main body according to the second embodiment.

FIG. 18 is a view showing a state where the connection rib is removed according to the second embodiment. FIG. 19 is a first view showing a state where the toner cartridge is attached to the image forming unit main body according to the second embodiment. FIG. 20 is a second view showing the state where the toner cartridge is attached to the image forming unit main body according to the second embodiment.

As shown in FIG. 18, removed connection rib 41 is first bent upward. Thereafter, when toner cartridge 19 is attached to image forming unit main body 65, protrusion 56 formed in rib receiver 55 is previously removed as shown in FIG. 19. Thus, connection rib 41 and protrusion 56 do not interfere with each other. Accordingly, toner cartridge 19 can be smoothly attached to image forming unit main body 65. On the other hand, as shown in FIG. 20, when it is attempted to attach toner cartridge 19 to image forming unit main body 65 while leaving protrusion 56, connection rib 41 and protrusion 56 interfere with each other. Therefore, it is possible to prevent toner cartridge 19 from being attached to image forming unit main body 65.

Note that it is possible to respond to more destinations, specifications and the like by increasing the number of connection ribs 41 or by changing a direction of bending connection rib 41.

In the embodiment, protrusion 56 is formed in toner cartridge 19 and connection rib 41 and protrusion 56 are allowed to interfere with each other. However, by allowing connection rib 41 and toner cartridge 19 having no rib receiver 55 formed therein to interfere with each other, it is possible to prevent toner cartridge 19 from being attached to image forming unit main body 65.

As described above, in the embodiment, connection rib 41 can be used for lock-out. Thus, in addition to the desirable results of the first embodiment, the toner can be prevented from leaking when a toner cartridge of a printer having different specifications is erroneously attached, for example. Moreover, when the embodiment is applied to a color printer, toner cartridges of different colors can be prevented from being erroneously attached to image forming unit main body 65 by setting the lock-out for each color. Thus, image quality can be improved.

Note that although connection rib 41 is bent and used for lock-out in the embodiment, connection rib 41 can also be used for lock-out by being completely cut off from upper frame 37 and then attached to a predetermined location.

In each of the embodiments, the printer as the image forming apparatus is described. However, the invention can be applied to a copier, a facsimile apparatus, a multifunction machine and the like.

As described above, the image forming unit according to the embodiments includes the image forming unit main body including the image carrier. The exposure device is disposed above the image forming unit main body and exposes the image carrier by exposing light onto the surface of the image carrier. The transfer member is disposed below the image forming unit main body and transfers the developer image formed on the surface of the image carrier. The housing of the image forming unit main body includes at least one opening. The connection element is suspended between the edge parts facing each other in the opening.

The image forming unit and the image forming apparatus according to the embodiments can interrupt formation of images on the medium or can reduce degradation of the image quality.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming unit, comprising:

an image forming unit main body including an image carrier;

a housing of the image forming unit main body, the housing having at least one opening having concave parts at edge parts facing each other in the at least one opening; and a connection element suspended with fracture parts between the edge parts facing each other in the at least one opening, the fracture parts located within the concave parts, wherein at least a part of the connection element corresponding to the image carrier is removable at the fracture parts.

2. The image forming unit of claim 1, wherein the connection element is formed approximately at a center portion in a longitudinal direction of the at least one opening.

3. The image forming unit of claim 1, wherein each of the fracture parts has a cross-sectional area reduced at a connection portion with a corresponding one of the edge parts.

4. The image forming unit of claim 3, wherein each of the fracture parts has a notch groove at the connection portion.

5. The image forming unit of claim 1, wherein the at least one opening is arranged facing to an exposure device that exposes the image carrier by exposing a surface of the image carrier.

6. The image forming unit of claim 4, wherein the at least one opening is a light receiving port for exposing the image carrier with light generated by the exposure device.

7. The image forming unit of claim 1, wherein the at least one opening is arranged facing to a transfer member that transfers a developer image formed on the surface of the image carrier.

8. The image forming unit of claim 7, wherein the at least one opening is a transfer port for transferring the developer image onto a medium.

9. The image forming unit of claim 1, wherein the fracture parts are thinner than the other portions of the connection element.

10. The image forming unit of claim 1, wherein the fracture parts are disposed at both ends of the connection element suspended between the edge parts facing each other.

11. The image forming unit of claim 1, wherein the fracture parts are thinner than the other portions of the connection element, while one of the fracture parts is thicker than the other fracture part.

12. The image forming unit of claim 1, further comprising:

a developer container that contains a developer and is disposed to be freely attached to and detachable from the image forming unit main body, wherein the at least one opening is a developer supply port through which the developer is supplied into the image forming unit main body from the developer container.

13. The image forming unit of claim 1, wherein the connection element is removed when the image carrier is attached to the image forming unit main body.

14. The image forming unit of claim 1, wherein the connection element is used for lock-out.

15. The image forming unit of claim 1, wherein the housing is mainly made of synthetic resin.

16. The image forming unit of claim 1, wherein the housing has an upper frame and a base frame.

17. The image forming apparatus comprising the image forming unit defined in claim 1.

18. The image forming unit of claim 1, wherein at least the part of the connection element corresponding to the image carrier is removed at the fracture parts.

19. The image forming unit of claim 1, wherein at least the part of the connection element corresponding to the image carrier is removed at the fracture parts, before the image carrier is installed to the image forming unit main body.

20. The image forming unit of claim 1, wherein at least the part of the connection element corresponding to the image carrier is removed at the fracture parts, when the image carrier is installed to the image forming unit main body.

* * * * *